United States Patent [19]

Jackson

[11] Patent Number: 4,876,955

[45] Date of Patent: Oct. 31, 1989

[54] EXTENSION FOR COMPACTING DEVICE

[76] Inventor: O. L. Jackson, 3324 Mustang Dr., Brooksville, Fla. 33512

[21] Appl. No.: 222,642

[22] Filed: Jul. 21, 1988

[51] Int. Cl.[4] ..... B30B 15/00

[52] U.S. Cl. ..... 100/219; 100/220; 100/229 A; 100/245; 100/252

[58] Field of Search ..... 100/219, 220, 227, 229 A, 100/245, 246, 247, 249, 251, 252

[56] References Cited

U.S. PATENT DOCUMENTS

| | | | |
|---|---|---|---|
| 255,091 | 3/1882 | Smith | 100/252 X |
| 260,493 | 7/1882 | Merry | 100/252 X |
| 260,571 | 7/1882 | Hunt | 100/245 |
| 357,814 | 2/1887 | Browne | 100/219 X |
| 3,979,008 | 9/1976 | Weeks et al. | 100/229 A X |
| 4,331,074 | 5/1982 | Behman | 100/227 X |
| 4,462,310 | 7/1984 | Jackson et al. | 100/219 |
| 4,760,784 | 8/1988 | Whiteside | 100/219 X |

FOREIGN PATENT DOCUMENTS

| | | | |
|---|---|---|---|
| 104317 | 6/1938 | Australia | 100/247 |
| 582560 | 10/1958 | Italy | 100/227 |

*Primary Examiner*—Stephen Marcus
*Assistant Examiner*—Christine A. Peterson
*Attorney, Agent, or Firm*—Sughrue, Mion, Zinn, Macpeak & Seas

[57] ABSTRACT

An extension is provided for a compacting device of the type adapted to be inserted into a container and having a plurality of compacting plates adapted to press loose material into the container and engage the compacting device to prevent expansion of the compacted material. The extension is adapted to sit on the upper end of the compacting device and extends above the container to hold excess loose material prior to compaction by the compacting plates. Smooth guide rods are provided on the inner surface of the extension for guiding the compacting plates into engagement with aligned threaded rods in the compacting device.

6 Claims, 1 Drawing Sheet

FIG. 1
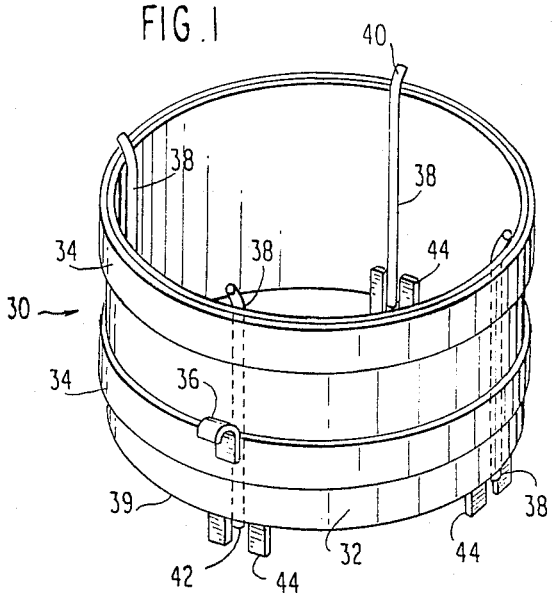
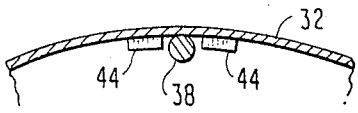
FIG. 3
FIG. 2
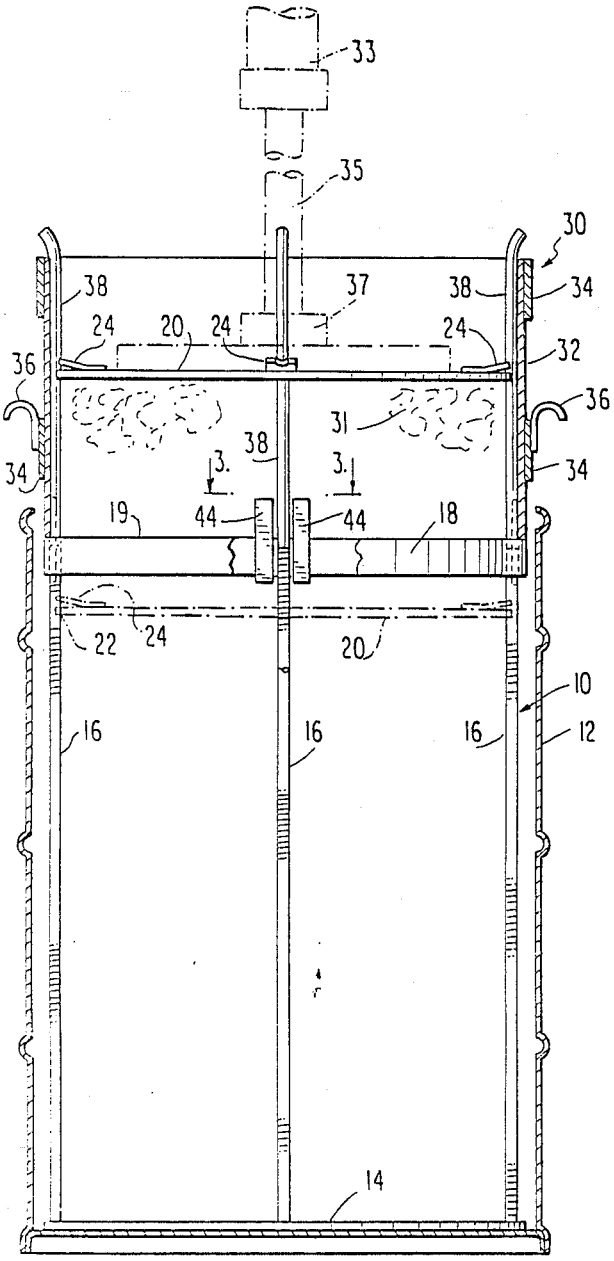
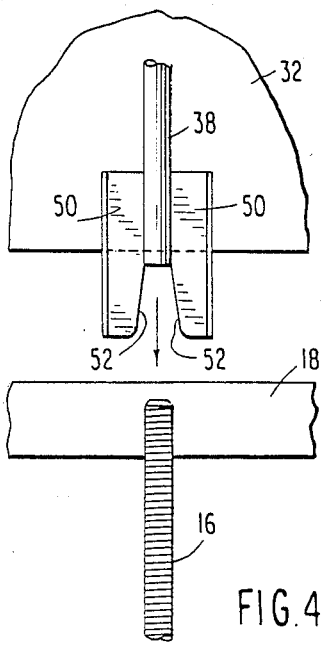
FIG. 4

EXTENSION FOR COMPACTING DEVICE

BACKGROUND OF THE INVENTION

The present invention is directed to an extension for a compacting device of the type adapted to be inserted in a container wherein one or more plates are secured at various levels to the compacting device within the container to prevent the compacted material from rebounding subsequent to compression thereby permitting the introduction of additional material for compaction wherein the extension provides an additional volume for the loose material and acts a guide for introducing the plates into the container.

In the packing of loose material into a container such as barrel or a drum, a plunger or some other type of compacting ram is utilized to compress the material into the container. However, upon withdrawal of the plunger to permit the introduction of additional material, the loose material previously compacted tends to spring back due to its own natural inherent resiliency and thereby limits the amount of additional material which can be added to the container. In order to increase the capacity of a container, it has been known in the past to insert spikes or pins through the sides of the container into the compacted material adjacent the plunger while the material is in the fully compacted condition. Upon withdrawal of the plunger to permit the introduction of additional material, the spikes will hold the previously compressed material in the compressed condition thereby substantially increasing the capacity of the container. As the container is gradually filled, the spikes are moved upwardly depending on the depth of the compressed material. Once the container is completely filled member may be secured to the container and the spikes can be removed.

An example of such a prior art arrangement as described above can be found in the U.S. Pat. No. 176,135 to Herbert directed to a tobacco press. In the tobacco press of this patent, a screw press is used for compacting tobacco within a hogshead and each successive charge of tobacco is held in the compressed condition by the insertion of pins through the staves between the screw press follower and the tobacco to hold the tobacco compacted upon withdrawal of the screw press follower to allow the insertion of additional tobacco. The pins are connected to the base plate by means of an adjustable chain so that the pins can be moved upwardly as the hogshead is filled with each successive charge. When the hogshead is substantially filled with compacted tobacco held in the compacted condition by means of the pins and additional loose tobacco is added for the purpose of filling up the remainder of the hogshead, the loose tobacco will tend to spill over the top of the hogshead and it will be difficult for the screw press follower to press the loose tobacco into the hogshead.

Applicant's prior U.S. Pat. No. 4,462,310 granted July 31, 1984 discloses a compacting device comprised of a base member adapted to be inserted into a container open at one end and having a peripheral configuration complementary to the cross-sectional configuration of the container. A plurality of threaded rods are secured in spaced locations to the periphery of the base member and are adapted to extend upwardly into proximity to the open end of the container. A supporting band is secured to the ends of the rods opposite the base member and has a configuration complementary to the periphery of said base member. At least one intermediate plate having a peripheral configuration substantially the same as the base member is adapted to be disposed between said rods parallel to said base member and locking means are secured to the intermediate plate and disposed in engagement with the rods to allow movement of the intermediate plate toward to the base member while preventing movement of the plate in the opposite direction. As each subsequent charge of loose material is added to the container, an additional plate is pressed into the compacting device to compress and hold the material in the compacted condition. When the container is substantially filled with compacted material, an additional charge of loose material will require a volume substantially larger than the remaining volume in the container and therefore the loose material will tend to spill over the top edge of the container. Furthermore, during the compacting action of the next plate, there are no guide means for guiding the plate in alignment with the preceding plates since the next plate was initially engaged with the loose material at a level substantially above the top edge of the compacting device within the container. Accordingly, some of this material may be lost and the next plate may be out of alignment with the threaded rods of the compacting device by the time the next plate is pressed into engagement with the rods.

SUMMARY OF THE INVENTION

The present invention provides an extension for use with a compacting device of the type disclosed in U.S. Pat. No. 4,462,310 wherein said extension is comprised of a hollow tubular sleeve adapted to be supported on the upper end of the compacting device and having a plurality of smooth, spaced apart rods secured to the interior surface of the sleeve for alignment with the rods of the compacting device.

The present invention provides a new and improved compacting device with an extension comprising a base member adapted to be inserted into a container open at one end and having a peripheral configuration complementary to the cross-sectional configuration of the container, a plurality of threaded rods secured in spaced locations to the periphery of said base member and adapted to extend upwardly into proximity to the open end of the container, a supporting band secured to the ends of said rods opposite said base member and having a configuration complementary to the periphery of said base member, at least one intermediate plate having a peripheral configuration substantially the same as said base member adapted to be disposed between said rods parallel to said base member, locking means secured to said intermediate plate and dispose in engagement with said rods to allow movement of said intermediate plate toward said base member while preventing movement of said plate in the opposite direction and an extension for said compacting device including a hollow tubular sleeve supported on said supporting band and having a plurality of smooth rods secured in spaced locations to the inner surface of said sleeve in alignment with respective threaded rods and locating means secured to said extension adjacent each smooth rod for engagement with a respective threaded rod to prevent rotation of said extension relative to said compacting device.

The foregoing and other objects features and advantages of the invention will be apparent in the following more particular description of a preferred embodiment of the invention as illustrated in the accompanied drawings.

BRIEF DESCRIPTION OF THE DRAWINGS

FIG. 1 is a perspective view of the extension according to the present invention.

FIG. 2 is side elevation sectional view of the extension in combination with a compacting device in a cylindrical drum with a press for compacting material within the drum shown in phantom lines.

FIG. 3 is a sectional view taken along the line 3—3 in FIG. 2.

FIG. 4 is an enlarged, exploded view showing a modified guide and rotation prevention arrangement between the extension and the compacting device.

DETAILED DESCRIPTION OF THE INVENTION

The compacting device according to the present invention may be utilized with any suitable container into which loose bulk material is adapted to be compacted. While the container may be a rectangular box, a wooden barrel or any other suitable container, the compacting device will be described in cooperation with a standard 55 gallon steel drum which is suitable for the disposal of hazardous materials or materials having a substantial amount of liquid associated therewith since a cover member may be securely welded to the open end of the container subsequent to the filling of the container.

As best seen in FIG. 2, the compacting device 10 according to the present invention is dimensioned to fit closely within the cylindrical walls of a steel drum 12 and extend from the bottom of the drum 12 to the open end thereof leaving only the necessary clearance for the securement of a cover to the open end of the drum. The compacting device 10 is comprised of a circular base plate 14 of any suitable strong, rigid material such as steel or the like. Four, equally spaced, threaded steel rods 16 are secured in equally spaced relation to the base plate 14 by any suitable means adjacent the periphery thereof. The steel rods 16 can be threaded into complementary threaded apertures in the base plate or may be welded directly to the surface of the base plate. A steel support ring 18 having outer dimensions substantially identical to the outer dimensions of the base plate 14 surrounds the upper ends of the threaded rods 16 which are secured to the inner surface of the ring 18 by any suitable means such as welding or the like. The frame of the compacting device is adapted to fit closely within the drum as best seen in FIG. 2.

A plurality of compacting plates 20 of any suitable strong rigid material are each provided with a plurality of notches 22 in the periphery thereof equal in number to the number of rods 16. The notches 22 are dimensioned so to fit closely about the rods 16 without contacting the same when the disk is inserted into the frame of the compacting device. Four spring metal locking plates 24 are secured to the upper surface of each plate 20 adjacent each notch 22 by welding, rivets, screws or any other suitable fastening means. The locking plates are each provided with a free end which is bent upwardly at an acute angle relative to the plane of the plate 20 in overlying relation to the respective notch 22. The free end of each spring locking plate 24 is provided with a notch 26 having a curvature substantially complementary to the cylindrical threaded rods 16 so as to engage the respective rod between adjacent threads on the rod.

In the operation of the compacting device a shown in FIG. 2, the compacting device 10 is inserted in a drum 12 and filled with a mass of relatively loose material 31 adapted to be compacted within the drum. Due to the looseness of the material 31, the material will substantially fill the drum initially. A first compacting disk 20 is then placed within the compacting device and pressed down manually until the locking tabs engage the threads on the rods 16. The drum is placed within a press which may be of the type having a hydraulic cylinder 33 and a reciprocating plunger 35 having a pressure head 37 secured to the lower end thereof. Upon operation of the hydraulic piston and cylinder assembly, the compacting plate 20 will be forced downwardly to compact the material 31 to the greatest possible extent. Assuming the material 31 between the base plate 14 and the first disk 20 is fully compacted, the plunger 35 is withdrawn from the drum 12 to permit the introduction of additional loose material 31 into the drum on top of the first compacting disk 20 which will remain in the position shown in FIG. 2 to prevent the previously compacted material from rebounding or expanding.

The introduction of additional loose material to be compacted will require a volume greater than the remaining volume in the drum and therefore the loose material tends to spill over the top edge of the barrel. Furthermore, with the material extending above the upper rim of the barrel, it is difficult to place the subsequent plate on top of the loose material in proper alignment with the threaded rods 16 since there are no guide means whatsoever for the next plate until the loose material is compacted below the top ends of the rods 16. Therefore, in order to provide the additional volume necessary to contain the excess loose material and to provide guide means for the plate above the upper ends of the threaded rod an extension as shown in FIG. 1 is provided.

The extension 30 is comprised of a hollow tubular sleeve 32 of steel or any other material having sufficient strength to maintain the cylindrical configuration for containing the material and guiding a compression plate. One or more reinforcing bands 34 may be secured to the outer surface of the sleeve 32 by any suitable means depending on the type of material utilized for the sleeve and the reinforcing bands 34. Assuming the sleeve and the bands to be constructed of steel, the reinforcing strips can be welded to the sleeve 32. Suitable hand grip members 36 may be welded to the reinforcing bands or directly to the sleeve to facilitate the handling of the sleeve since the sleeve must be moved into and out of engagement with the compacting device as shown in FIG. 2. Four equally spaced smooth steel rods 38 are welded to the inner surface of the sleeve 32 with the upper ends 40 extending upwardly and outwardly over the upper ends of the sleeve 32. The lower ends 42 of the rods 38 extend below the lower edge of the sleeve 32 at a distance substantially equal to the distance between the top ends of the threaded rods 16 and the upper edge of the support ring 18.

The extension 30 as shown in FIG. 1 can be mated with the upper end of the compacting device 10 as shown in FIG. 2 with the lower edge 39 of the sleeve 32 resting on the upper surface 19 of the ring 18 and the lower end 42 of each smooth rod 38 resting on the upper end of each thread rod 16. The ends of the smooth rods and the threaded rods do not absolutely have to be in engagement with each other but can be slightly spaced from each other since the weight of the extension can be carried by the support ring 18. In order to maintain the rods 38 in alignment with the rods 16, a pair of guide bars 44 may be welded to the interior surface of the sleeve 32 on opposite sides of each smooth rod 38. The bars 44 extend below the lower edge 39 of the sleeve 32 and are located on opposite sides of the upper end of each threaded rod 16 as shown in FIG. 2 thereby preventing rotation of the extension 30 relative to the compacting device 10 so that the rods 38 and 16 will be maintained in substantial alignment with each other.

As best seen in FIG. 2, the loose material can now extend upwardly above the upper end of the drum 12 into the volume defined by the sleeve 32. The compacting plate 20 can then be inserted into the upper end of the extension 30 with the notches 22 aligned with the respective rods 38 and the locking plates 24 disposed in sliding engagement with the smooth rods 38. Since the upper ends of the rods 38 are bent outwardly above the upper end of the sleeve 32, this facilitates the feeding of the compacting plate 20 into the extension for downward compacting movement. The operation of the hydraulically operated pressure assembly 33–37 then pushes the compacting plate 20 downwardly through the extension into engagement with the threaded rods 16 to compact the loose material 31. The extension 30 can be of any desired length depending upon the nature and amount of loose material which should be compacted on each stroke of the hydraulic press.

To facilitate the placing of the extension 30 on the upper end of the compacting device 18, guide bars 15 falling opposed downwardly diverging guide surfaces 52 may be secured to the sleeve 32 on opposite sides of each smooth rod 38 as shown in the embodiment of FIG. 4. Thus, the engagement of the upper end of the threaded rod 16 with the tapered guide surfaces 52 will bring the rods 38 into exact alignment with the rod 16 upon lowering of the extension 30 onto the compacting device 10.

After the final compaction of waste material into the drum, the uppermost compacting plate 20 secured to the threaded rods within the drum will be disposed in close proximity to the top edge or rim of the drum 12. The extension may then be removed and the drum closed by means of a lid or cover which may be tightly sealed to the drum thereby placing the drum 12 in condition for disposal. The extension may then be placed on the compacting device within another drum to facilitate the filling and compacting operation.

While the invention has been particularly shown and described in reference to a preferred embodiment thereof, it will be understood by those in the art that the various changes in form and detail can be made therein without departing from the spirit and scope of the invention.

What is claimed is:

1. An extension for use with a compacting device adapted to be inserted into a container wherein the compacting device comprises:

a base member, a plurality of equally spaced threaded rods secured to the base member, a supporting band secured about the upper ends of the rods and a plurality of plates with unidirectional locking means adapted to be inserted within the rods for compacting loose waste material and preventing springback;

said extension comprising:

a hollow tubular sleeve adapted to be supported on said supporting bands and having a plurality of smooth rods secured in spaced locations to the inner surface of said sleeve in alignment with respect to the threaded rods and locating means secured to said extension adjacent each smooth rod for engagement with a respective threaded rod to prevent rotation of said extension relative to said compacting device when used in conjunction with said compacting device.

2. An extension as set forth in claim 1, wherein said smooth rods extend upwardly and outwardly over a top edge of said tubular sleeve to assist in guiding compacting plates into the extension.

3. An extension as set forth in claim 1, wherein said locking means is comprised of projecting members secured to said sleeve on opposite sides of at least one smooth rod and projecting downwardly below said sleeve with opposing surfaces of said projecting members tapered downwardly away from each other to provide guide surfaces for bringing the smooth rod into alignment with a threaded rod of a compacting device.

4. A compacting device of the type adapted to be closely fitted within a container for compacting material within the container and maintaining the material in compacted condition comprising:

a base member having a peripheral configuration complementary to the cross-sectional dimensions of the container and adapted to be placed at the bottom of the container, a plurality of rods disposed perpendicular to said base member and secured at one end to said base member adjacent the periphery thereof in substantially equally spaced relation, a supporting band having a peripheral configuration substantially identical to the peripheral configuration of the bottom member extending about said rods and secured to the opposite ends of said rods, at least one compacting plate having a peripheral configuration similar to the peripheral configuration of said base member and adapted to fit within said rods perpendicular thereto, locking means secured to said compacting plate and disposed in engagement with said threaded rods to permit movement of said compacting plate towards said base member while preventing movement of said compacting plate in the opposite direction, and an extension for said compacting device comprising a hollow tubular sleeve supported on said supporting band and having a plurality of smooth rods secured in spaced locations to the inner surface of said sleeve in alignment with respective threaded rods and locating means secured to said extension adjacent each smooth rod for engagement with a respective threaded rod to prevent rotation of said extension relative to said compacting device.

5. An extension as set forth in claim 4, wherein said smooth rods extend upwardly and outwardly over a top edge of said tubular sleeve to assist in guiding compacting plates into the extension.

6. An extension as set forth in claim 4, wherein said locking means is comprised of projecting members secured to said sleeve on opposite sides of at least one smooth rod and projecting downwardly below said sleeve with opposing surfaces of said projecting members tapered downwardly away from each other to provide guide surfaces for bringing the smooth rod into alignment with a threaded rod of a compacting device.

* * * * *